US010294705B2

(12) United States Patent
Hirtsiefer et al.

(10) Patent No.: US 10,294,705 B2
(45) Date of Patent: May 21, 2019

(54) FURNITURE HINGE

(71) Applicant: SAMET KALIP VE MADEN ESYA SAN. VE TIC. A.S., Kirac Esenyurt-Istanbul (TR)

(72) Inventors: Artur Hirtsiefer, Neunkirchen-Seelscheid (DE); Bernd Rödder, Ruppichteroth (DE); Nurettin Güzeltepe, Büyükçekmece/Istanbul (TR)

(73) Assignee: Samet Kalip Ve Maden Esya San. Ve Tic. A.S., Istanbul (TR)

( * ) Notice: Subject to any disclaimer, the term of this patent is extended or adjusted under 35 U.S.C. 154(b) by 0 days.

(21) Appl. No.: 15/512,722

(22) PCT Filed: Sep. 4, 2015

(86) PCT No.: PCT/EP2015/070270
§ 371 (c)(1),
(2) Date: Mar. 20, 2017

(87) PCT Pub. No.: WO2016/045943
PCT Pub. Date: Mar. 31, 2016

(65) Prior Publication Data

US 2017/0292307 A1 Oct. 12, 2017

(30) Foreign Application Priority Data

Sep. 26, 2014 (DE) ..... 10 2014 113 967

(51) Int. Cl.
*E05F 1/08* (2006.01)
*E05F 1/12* (2006.01)
(Continued)

(52) U.S. Cl.
CPC ..... *E05F 1/1276* (2013.01); *E05D 3/16* (2013.01); *E05D 11/00* (2013.01); *E05F 1/12* (2013.01);
(Continued)

(58) Field of Classification Search
CPC ..... E05F 1/1276; E05F 1/1246; E05F 1/1253; E05F 1/1261; E05F 1/1058; E05F 1/1075;
(Continued)

(56) References Cited

U.S. PATENT DOCUMENTS 7,810,213 B2 * 10/2010 Brustle ..... E05F 1/1075 16/286
8,225,459 B2 * 7/2012 Waltemate ..... E05D 3/16 16/286
(Continued)

FOREIGN PATENT DOCUMENTS

CN 101663451 3/2010
CN 102472067 5/2012
(Continued)

OTHER PUBLICATIONS

Chinese Search Report issued in connection with application No. 2015800513857.
(Continued)

*Primary Examiner* — Chuck Y Mah
(74) *Attorney, Agent, or Firm* — Steven M. Shape; Dennemeyer & Associates, LLC

(57) ABSTRACT

The invention relates to a furniture hinge with a fastening portion and a hinge part connected thereto via a multi-axis articulated connection, wherein a spring preloads the hinge part directly or indirectly, at least in a subregion of the adjustment path of the hinge part, with respect to the fastening portion, and wherein the spring is mounted or can be mounted under tension between two spring bearings. In
(Continued)

order, in such a furniture hinge, to achieve improved movement control and to make the required manual force for hinge opening or closing more even, provision is made according to the invention for the spring (76) to be adjusted in the region of its two spring bearings (74, 84.4) during the adjustment of the hinge part (20) from the opening into the closing position and/or during the adjustment from the closing into the opening position.

13 Claims, 7 Drawing Sheets

(51) Int. Cl.

| | |
|---|---|
| ***E05D 3/16*** | (2006.01) |
| ***E05D 11/00*** | (2006.01) |
| ***E05F 3/20*** | (2006.01) |
| *E05F 1/10* | (2006.01) |

(52) U.S. Cl.
CPC ..... *E05F 3/20* (2013.01); *A47B 2220/0072* (2013.01); *E05F 1/1075* (2013.01); *E05Y 2201/21* (2013.01); *E05Y 2201/47* (2013.01); *E05Y 2201/492* (2013.01); *E05Y 2900/20* (2013.01)

(58) Field of Classification Search
CPC ... E05F 3/20; E05D 3/16; E05D 11/00; E05Y 2201/21; E05Y 2201/264; E05Y 2201/47; E05Y 2201/492; E05Y 2900/20; E05Y 2900/202; A47B 2220/0072; Y10T 16/5383; Y10T 16/547; Y10T 16/5476
See application file for complete search history.

(56) References Cited

U.S. PATENT DOCUMENTS

| | | | | |
|---|---|---|---|---|
| 8,321,996 | B2 * | 12/2012 | Hirtsiefer | E05D 3/14 16/286 |
| 8,752,811 | B2 * | 6/2014 | Mischler | B23Q 11/0035 173/162.1 |
| 8,807,670 | B2 * | 8/2014 | Blum | E05F 1/1276 16/286 |
| 8,959,709 | B2 * | 2/2015 | Hasegawa | E05D 3/14 16/50 |
| 2007/0124893 | A1 * | 6/2007 | Brustle | E05F 1/1075 16/296 |
| 2010/0162847 | A1 * | 7/2010 | Gassner | E05F 1/1058 74/490.07 |
| 2014/0215761 | A1 * | 8/2014 | Zetti | E05D 3/16 16/288 |
| 2014/0317883 | A1 * | 10/2014 | Baldreich | E05F 1/1058 16/280 |
| 2014/0319987 | A1 * | 10/2014 | Blum | E05F 1/1276 312/319.2 |
| 2015/0351539 | A1 * | 12/2015 | Baldreich | E05D 11/1064 312/319.2 |
| 2017/0241176 | A1 * | 8/2017 | Zetti | E05D 3/16 |

FOREIGN PATENT DOCUMENTS

| | | | | |
|---|---|---|---|---|
| CN | 101111655 | A | 1/2018 | |
| DE | 4003704 | A1 | 8/1991 | |
| EP | 0994229 | | 4/2000 | |
| EP | 2712988 | A2 | 4/2014 | |
| EP | 2762666 | A1 * | 8/2014 | E05D 3/16 |
| EP | 2762666 | A1 | 8/2014 | |
| EP | 2712988 | A3 * | 9/2016 | E05D 3/16 |
| WO | WO-2007042094 | A1 * | 4/2007 | E05D 3/16 |

OTHER PUBLICATIONS

Chinese Office Action issued in connection with appolication No. 201580051385.7 dated May 23, 2018.
Russian Office action issued in connection with application No. 100,181 dated May 5, 2018.

* cited by examiner

FURNITURE HINGE

CROSS-REFERENCE TO RELATED APPLICTIONS

This application claims priority to German application 102014113967.4, filed Sep. 26, 2014, which is hereby incorporated by reference in its entirety.

BACKGROUND OF THE INVENTION

The invention relates to a furniture hinge having a fastening portion and a hinge part that is connected to the latter by way of a multiple-axle articulation connection, wherein a spring indirectly or directly biases the hinge part in relation to the fastening portion at least in a part-region of the readjustment path of the hinge part, and wherein the spring is tensioned or tensionable between two spring bearings.

Furniture hinges of this type are used in order to move a pivotable flap between an opening and a closing position, for example. So-called flap fittings of this type are usually used in the construction of furniture and are employed in the region of wall units. The flaps herein are pivotable about a horizontal axis. Ideally, such a flap fitting should hold the flap in a self-acting manner in an intermediate position in the intermediate repositioning path between the opening motion the closing motion. In the range of the opening stroke, the flap has to be held in a reliable and stable manner such that said flap does not return in a self-acting manner to the closing position. In the range of the closing stroke, the flap should be reliably pulled to the closing position. In order for such coordinated repositioning paths to be achieved, furniture hinges are usually used in which spring-biased control curves having a complex control geometry are used. It is disadvantageous in the case of these furniture fittings that the bias that is applied by the spring is very high in the closing position and in comparison thereto is smaller in the opening position. This leads to an unnatural motion sequence which is considered disruptive by some users. This issue is additionally amplified when flaps of dissimilar weight are employed on the furniture hinges. Such a furniture hinge is known from EP 1713996 B1, for example.

It is therefore an object of the invention to provide a furniture hinge of the type mentioned at the outset, in which an optimized closing motion is enabled.

This object is achieved according to the invention in that the spring during the readjustment of the hinge part from the opening to the closing position, and/or during the readjustment from the closing to the opening position is readjusted in the region of the two spring bearings thereof.

As opposed to the prior art, in which at all times one spring bearing is fixedly disposed and the second spring bearing is readjustable in relation to the former in order for the spring to be tensioned or to be relaxed, the invention now follows another path. In the case of the furniture hinge according to the invention, both spring bearings are now readjusted during the opening and/or the closing motion. The second spring bearing may thus be conjointly guided during the motion sequence, such that the spring force of the spring may be regulated during the motion sequence. On account thereof, homogenizing or adapting in a tuned manner to the respective application case may be particularly performed in a targeted manner. In particular, according to a respective layout of the system, a hinge variant in which the second spring bearing in the range of the closing stroke is readjusted in the direction of the closing stroke, so as to reduce the spring tension on account thereof may also be implemented. Accordingly, it may also be provided that a potential furniture hinge in the range of the opening stroke is designed in such a manner that the two spring bearings are readjusted in opposite directions, so as to achieve additional tensioning of the spring. The furniture hinge according to the invention may be embodied by way of the readjustment of the two spring bearings, in particular also so as to be of small installation space, since complex control mechanisms such as control curves may be dispensed with.

BRIEF SUMMARY OF THE INVENTION

According to one preferred variant of the invention it may be provided that at least one of the spring bearings is readjustable in a linear manner by means of a linear guide, or is pivotable about an axle. An aligned motion sequence may be implemented by way of a linear guide. Moreover, a comparatively large readjustment stroke is achieved in a small installation space in the case of a linear guide. Alternatively, it may also be provided that the second spring bearing is pivotable about an axle in order to effect the readjustment stroke in the second spring region. Finally, it is also conceivable for the second spring bearing to be readjustable on an arcuate path by means of a guide. In particular, this arcuate path may be embodied in such a manner that the spring bearing carries out a combined linear and pivoting motion. Moreover, the torque that is induced into the region of the spring bearing may be varied by means of arcuate or pivotable spring bearings.

A particularly preferred variant of the invention is of such a design that the spring by means of the two spring bearings is in each case coupled to one lever, wherein the levers are mutually pivotable. In this way, a simple kinematics which serves for tensioning the spring is achieved. In the context of the invention, these two levers may be conjointly offset, for example. Both spring bearings may be readjusted by offsetting.

Additionally, the spring bearings may be mutually readjusted as a result of the levers being pivoted.

It may be provided in particular that the articulation connection is indirectly or directly coupled to both spring bearings by means of a setting unit, and that the spring bearings are readjusted by means of the setting unit. In the arrangement described above, which uses two levers, a simple hinge construction may be implemented in that the setting unit acts on that connection region of the two levers to which the spring bearings are coupled. For example, the setting unit may act directly on the articulation point between the two levers, or be coupled to this articulation.

The setting unit is particularly preferably configured as a movable lever which by way of an articulation that forms a first rotation axle is indirectly or directly coupled to the articulation connection. A minor effort in terms of parts and assembly may be implemented by way of such a furniture hinge.

One potential variant of the invention may be designed in such a manner that one spring bearing is connected to a spring tensioner by means of which the spacing between the spring bearings is adjustable. The spring force may be adjusted to dissimilar flap weights by way of the spring tensioner, for example. One further preferred variant of the invention is designed in such a manner that the opening motion of the hinge part and/or the closing motion of the hinge part is dampable at least in regions by means of a damper element. The flap or the door that is articulated on the furniture hinge is delicately pulled to the opening or closing position by way of the damper element, wherein the damping force counteracts the tensile force of the spring. If and when it is provided for the damper element to damp both in the opening as well as in the closing direction, the effort in terms of parts for the furniture hinge may be minimized.

The damper element may be configured as a rotary damper or preferably as a linear damper, and in particular as a fluid-type damper. In comparison, linear dampers have a simpler construction than rotary dampers, this having an advantageous effect in the case of furniture hinges which are made as a mass product.

Damping may then be readily integrated in the furniture hinge if and when it is provided that the damper element is effective in the functional region between the articulation connection and the spring.

The invention in particular also relates to an item of furniture having a furniture base unit and a flap or a door that is articulated thereon by means of a furniture hinge, wherein the manual force required during the opening and/or closing motion remains almost constant. It is preferably provided that the manual force required remains constant at a deviation of +/−30%, so as to generate the impression of a motion sequence that is as harmonic as possible with a user. The manual force is that force that has to be applied to the activation element of the flap or door in order to move the flap or door to the opening and/or closing position.

BRIEF DESCRIPTION OF THE DRAWINGS

The invention will be explained in more detail hereunder by means of an exemplary embodiment which is illustrated in the drawings. In the drawings.

DETAILED DESCRIPTION OF THE INVENTION

Figure 1:
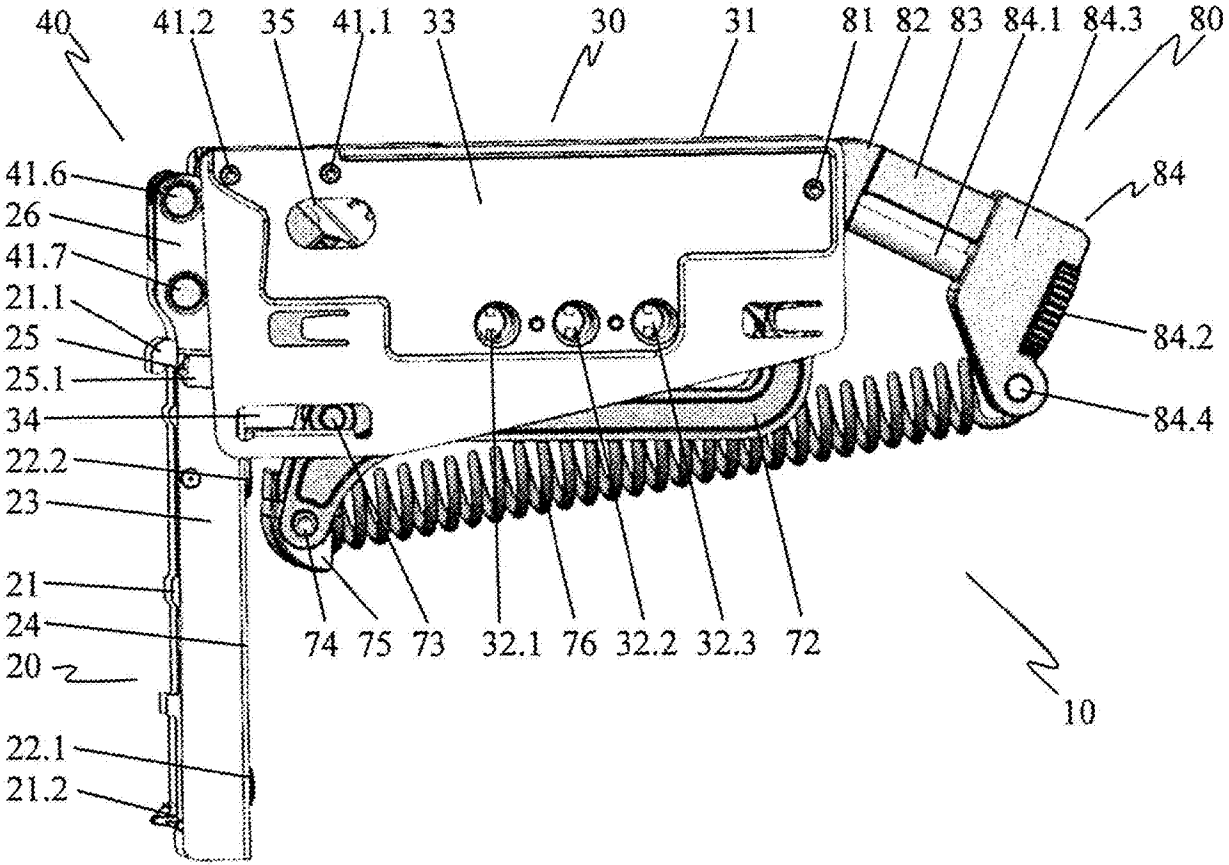
FIG. 1 shows a furniture hinge in first terminal position of an inwardly folded hinge part, in the case of a closed hinge housing, in a side view.

FIG. 1 shows a furniture hinge 10 in first terminal position of an inwardly folded hinge part 20, in the case of a closed hinge housing 31, in a side view. The hinge part 20 serves for coupling to a door or a flap, and may be configured as a hinge arm, as is presently the case.

The hinge housing 31 forms a fastening portion 30 of the furniture hinge 10, having three fastening receptacles 32.1, 32.2, 32.3. The hinge housing 31 in the illustration is closed off by a housing lid 33. A linear guide 34 and an adjustment opening 35 are provided as passage openings in the housing lid 33. Fastening points of a first articulation 41.1, of a second articulation 41.2, and of a rotary joint 81 are sunk into the housing lid 33.

The hinge arm 20 is pivotably connected to the fastening portion 30 by way of a multiple-axle articulation connection 40. A first and a second set screw 22.1, 22.2 are disposed along a rear web 24 of the hinge part 20. Lateral legs 23 adjoin the rear web 24 on either side. The hinge part 20 has a connection element 21 which has connection hooks 21.1, 21.2. Toward the articulation, the lateral legs 23 transition to an articulation guide 26 by way of an expansion region 25 that is reinforced by an embossing 25.1. A sixth articulation 41.6 and a seventh articulation 41.7 of the multiple-axle articulation connection 40 (presently a seven-articulation chain) are disposed on the articulation guide 26.

The multiple-axle articulation connection 40 is connected to the fastening portion 30 by way of the first and the second articulation 41.1, 41.2, and is connected to the hinge part 20 by way of the sixth and seventh articulation 41.6, 41.7.

A lever which is presently configured as a spring tensioner 80 is attached to the fastening portion 30 by way of the rotary joint 81, so as to be opposite the articulation connection 40. The spring tensioner 80 is assigned a tensioning element 84 that is composed of a knurled screw 84.1 having a knurled head 84.2 and a slide 84.3 having a spring bearing 84.4 attached thereto. The slide 84.3 is mounted so as to be displaceable on a slider bar 83. The slider bar 83 and the knurled screw 84.1 at the end side are fixed to a common base 82 which establishes the connection to the fastening portion 30 of the furniture hinge 10.

A spring 76 is hooked to the spring bearing 84.4, the former by way of the opposite end thereof being fastened to a spring bearing 74. The spring bearing 74, by way of a pin 74, at the end side is connected to a first lever which presently is configured as a connection lever 72. The connection lever 72 by way of a guide pin 73 is guided in the linear guide 34 that is attached to the housing 33.

In the fitted state, the hinge part 20 is assigned to a cupboard door or to a flap, and the fastening portion 30 is assigned to the base unit of an item of furniture (not illustrated). Herein, the connection element 21 by way of the connection hooks 21.1, 21.2 engages in a connection piece (not illustrated) which is fastened to the cupboard door or to the flap. The cupboard door or the flap may be aligned in relation to the base unit by way of the set screws 22.1, 22.2. The fastening portion 30 by means of fastening means (not illustrated) which are routed through the fastening receptacles 32.1, 32.2, 32.3, is fastened to the base unit.

Figure 6:
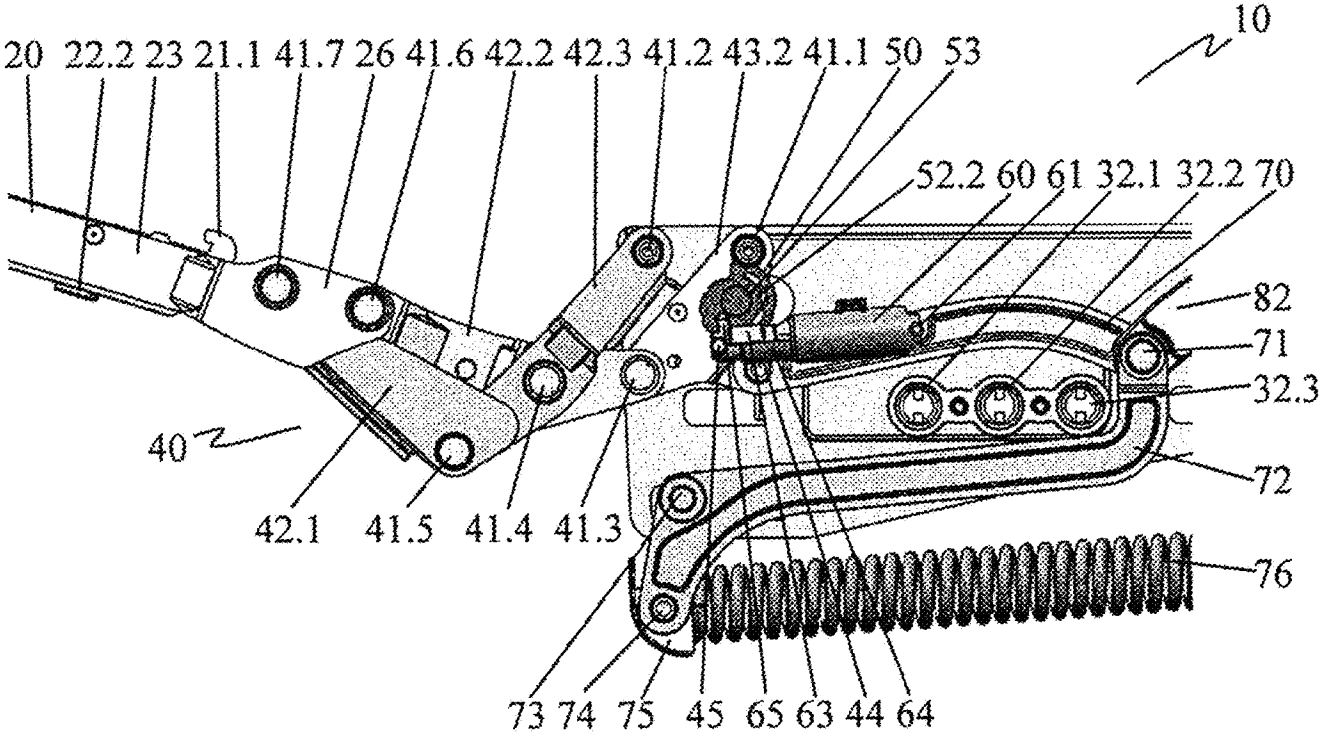
FIG. 6 shows the furniture hinge of FIG. 2 in a second terminal position, in the case of an outwardly folded hinge part.

The hinge part 20, during opening of the cupboard door or of the flap, is pivoted from the closed first terminal position shown to an opened second terminal position shown in FIG. 6. The spring 76 herein, as from a specific position of the hinge part 20, causes the cupboard door or the flap to open in a self-acting manner. Accordingly, the spring 76, during closing of the cupboard door or of the flap, pulls the hinge part 20 on the last movement portion thereof back to the first terminal position of the latter. The bias of the spring 76, and the torque acting about the rotary joint 81 as a result of a variation in the spacing between the rotary joint 81 and the spring bearing 84.4, may be adapted to the respectively fitted cupboard door or flap by way of the spring tensioner 80, such that cupboard doors or flaps of variable weights and dimensions may be opened or closed, as has been described. This may be achieved in that the slide 84.3 of the tensioning element 84, by rotating the knurled screw 84.1 at the knurled head 84.2 thereof, readjusts along the slider bar 83 until the desired bias of the spring 76 that is connected to the slide is provided, and/or until the desired torque has been set.

Figure 2:
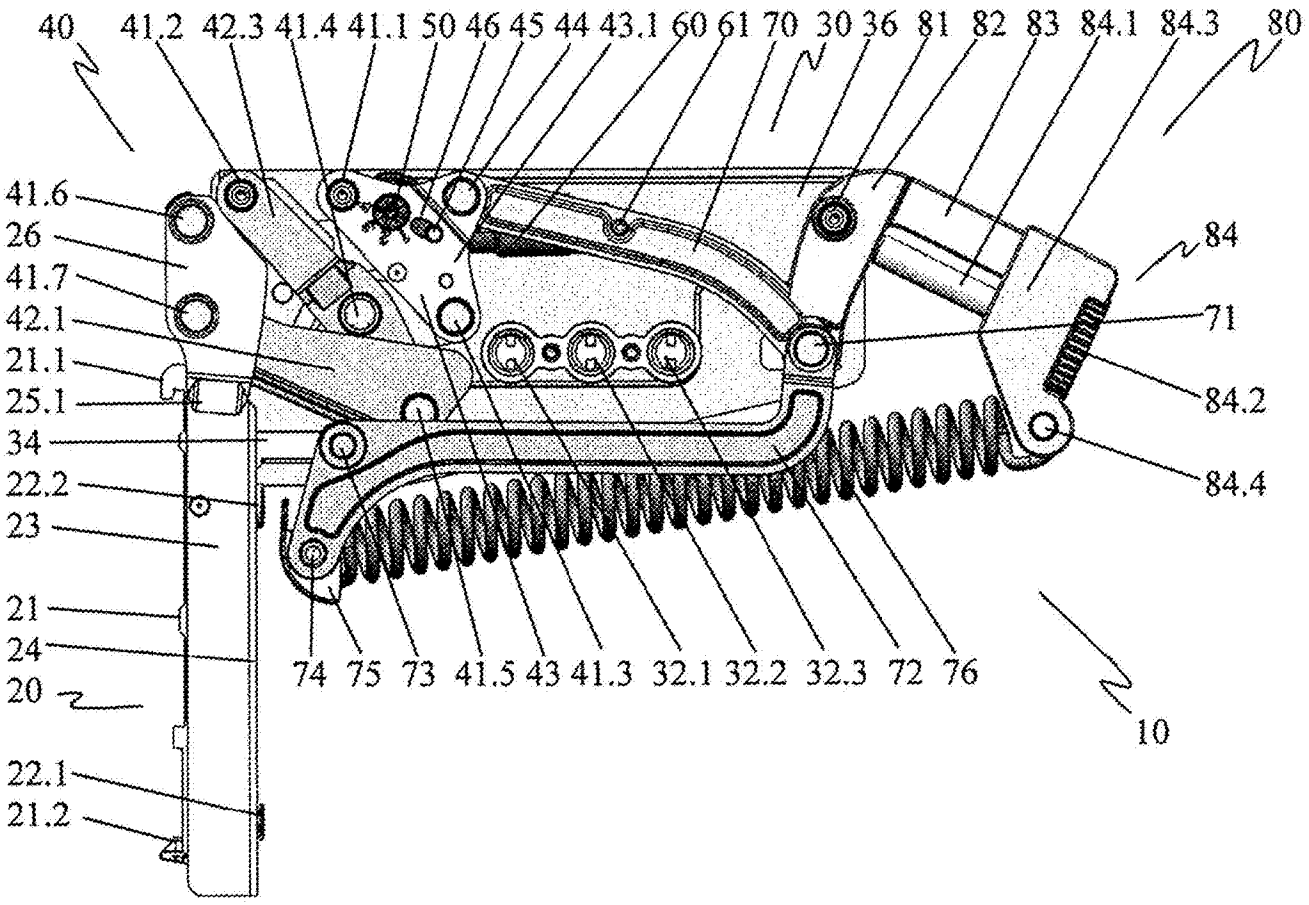
FIG. 2 shows the furniture hinge of FIG. 1, in the case of an opened hinge housing.

FIG. 2 shows the furniture hinge 10 of FIG. 1, in the case of an opened hinge housing 31. Identical components herein are referenced as has been introduced in FIG. 1.

The hinge housing 31 at the rear side is closed off by way of a rear housing wall 36 which has the same passages, articulation receptacles, and fastening receptacles 32.1, 32.2, 32.3 as the housing lid 33 that is shown in FIG. 1. Components of the furniture hinge 10 may thus be held or routed between the housing lid 33 and the rear housing wall 36. The furniture hinge 10 may be fitted to a cupboard base unit both on the right as well as the left side, wherein either the rear housing wall 36 or the housing lid 33 bears on the cupboard wall.

Figure 3:
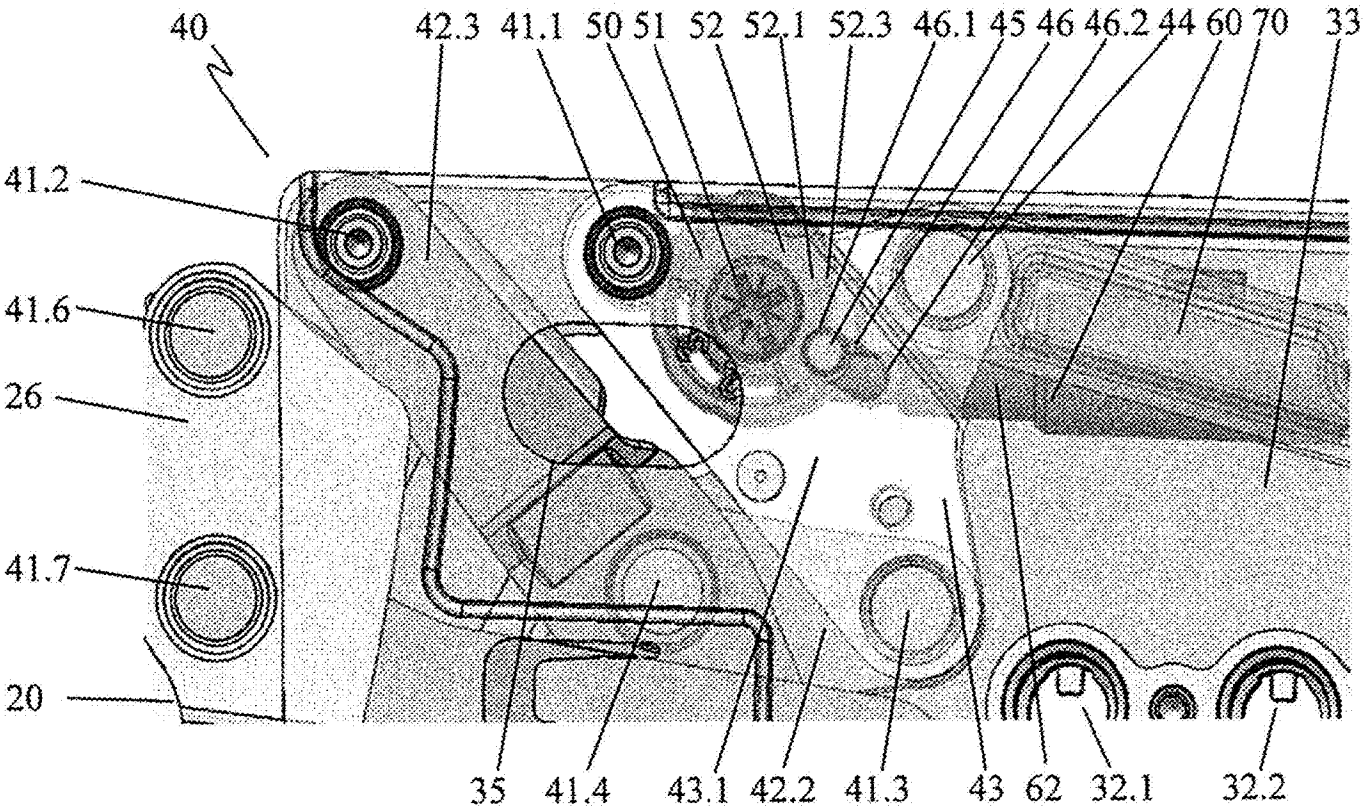
FIG. 3 shows a fragment of the furniture hinge of FIG. 2, in the region of an articulation element.
Figure 4:
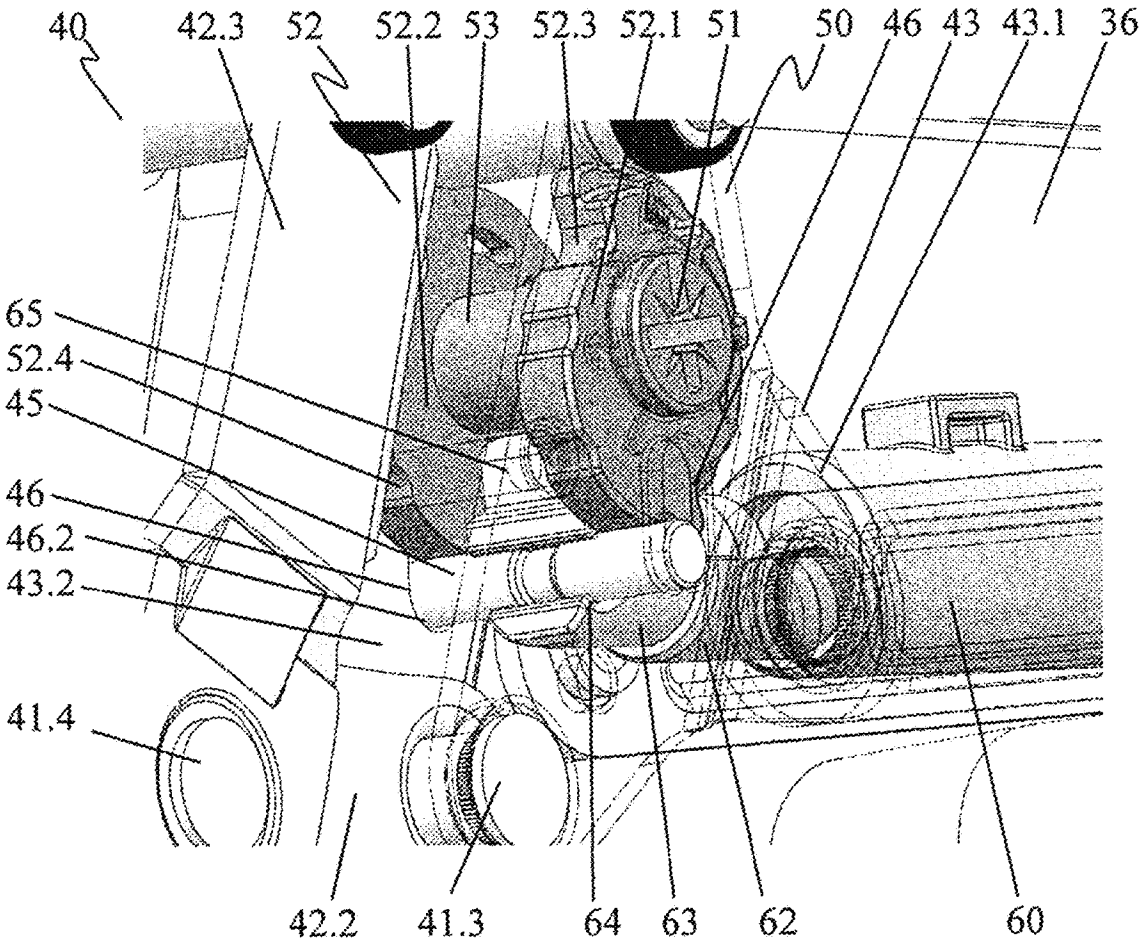
FIG. 4 shows the fragment of the furniture hinge of FIG. 3, in a perspective illustration, in the case of a partially outwardly folded hinge part.

A first articulation lever 42.1 of the multiple-axle articulation connection 40 is disposed between the seventh articulation 41.7 on the articulation guide 26 of the hinge part 20, and a fifth articulation 41.5 that is displaceable in the position thereof. A second articulation lever 42.2 that is shown in FIGS. 3, 4, and 6 is accordingly disposed between the sixth articulation 41.6 on the articulation guide 26 of the hinge part 20, and a third articulation 41.3 that is likewise displaceable in the position thereof. A third articulation lever 42.3 is rotatably fastened to the hinge housing 31 by means of the second articulation 41.2. The third articulation lever 42.3 in the central region thereof, by way of a fourth articulation 41.4 is likewise rotatably connected in an approximately centric manner to the second articulation lever 42.2.

An approximately triangular articulation element 43 at one corner is rotatably connected to the hinge housing 31 by way of the first articulation 41.1. The articulation element 43 at an opposite corner is rotatably connected to the second articulation lever 42.2 by way of the third articulation 41.3. A first rotation axle 44 in the form of a further articulation axle is disposed on a third corner of the articulation element 43 that faces away from the multiple-axle articulation connection 40. The articulation element 43 herein is rotatably connected to one end of a bent movable lever 70.

Figure 5:
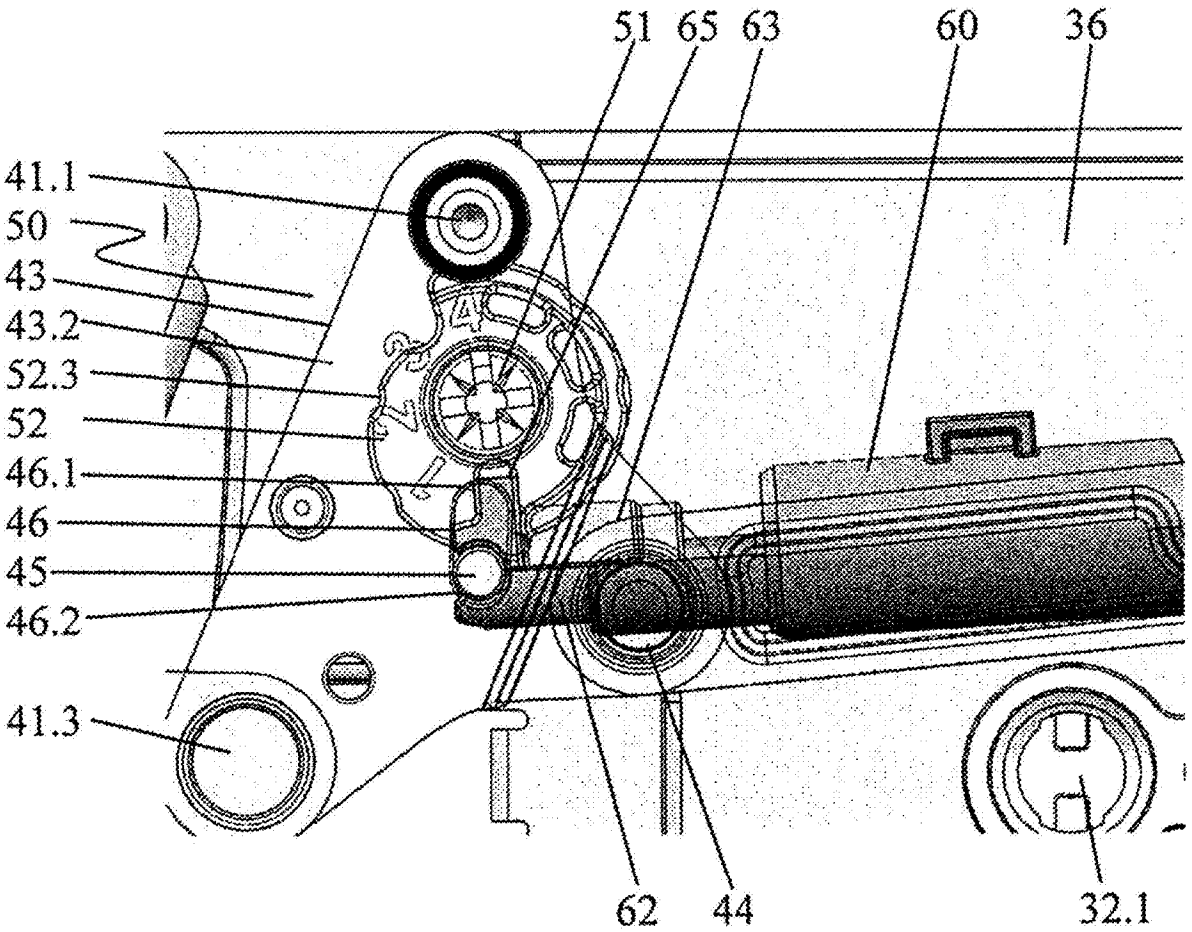
FIG. 5 shows the fragment of the furniture hinge of FIG. 4, in a side view.

The articulation element 43 has two mutually opposite articulation plates 43.1, 43.2 that are disposed so as to be spaced apart, wherein the forward first articulation plate 43.1 can be seen in the illustration chosen in FIG. 2. The rearward second articulation plate 43.2 that is shown in FIGS. 4, 5, and 6, is obscured by the first articulation plate 43.1. A guide 46 in the form of elongate holes, each aligned in the direction toward the first articulation 41.1, is provided in the central region of the articulation plates 43.1. An adjustment element 50 is disposed between the guide 46 and the first articulation 41.1.

A damper element 60, damping in a linear manner, by way of a guide element 45 is mounted so as to be rotatable and displaceable in the elongate holes of the guide 46. The damper element 60, at the opposite end thereof, by way of a counter bearing 61 is rotatably fastened to the movable lever 70.

The movable lever 70, the base 82 of the spring tensioner 80, and the connection lever 72 each are interconnected at the end side by way of an articulation axle 71.

The multiple-axle articulation connection 40, by way of the seven articulations 41.1, 41.2, 41.3, 41.4, 41.5, 41.6, 41.7 thereof, configures a known seven-way articulation connection between the hinge part 40 and the fastening portion 30. During outward folding of the hinge part 20 to an opened second terminal position that is shown in FIG. 6, the third articulation lever 42.3 is rotated about the second articulation 41.2, and the articulation element 43, by way of the first and the second articulation plate 43.1, 43.2 thereof, is rotated about the first articulation 41.1. On account thereof, the first rotation axle 44 in the illustration chosen is pivoted about the first articulation 41.1 in the clockwise direction. The first rotation axle 44 herein crosses the connection line between the guide element 45 and the counter bearing 61, and thus between the support bearings of the damper element 60. Herein, proceeding from the first terminal position illustrated, the spacing between the guide element 45 and the counter bearing 61 is enlarged until the guide element 45, the first rotation axle 44, and the counter bearing 61 are in line. If and when the articulation element 43 is rotated farther beyond this point about the first articulation 41.1, the spacing between the guide element 45 and the counter bearing 61 is again decreased. The motion sequence is performed in the reversed order during folding back of the hinge part 20. The damper element 60 during a folding motion of the hinge part 20 between the two terminal positions, during intersecting of the line connecting the support bearings of the damper element 60 and the first rotation axle 44, thus performs maximum deflection within the readjustment motion. The deflection of the damper element 60 is again decreased during continuation of the rotating motion.

The damper element 60 used acts in a damping manner only in one readjustment direction, during collapsing of the damper element 60. No damping of the movement of the articulation element 43 and of the hinge part 20 is thus performed in the motion sequence described, until the maximum deflection of the damper element 60 is achieved. After the maximum deflection, the damper element 60 by contrast acts in a damping manner on the movement of the articulation element 43 and thus, transmitted by the multiple-axle articulation connection 40, on the movement of the hinge part 20. Since the readjustment direction of the damper element 60 is reversed both during inward folding as well as during outward folding of the hinge part 20, damping of the latter is in each case performed prior to achieving one of the terminal positions of the hinge part 20. On account thereof, both damped opening as well as damped closing of a cupboard door or flap that is fastened to the hinge part 20 is achieved by way of only one damper element that damps in a linear manner in one direction.

By way of the spring 76 that is tensioned between the spring tensioner 80 and the connection lever 72, the spring tensioner 80 is rotated about the rotary joint 81, and the connection lever 72 is rotated counter thereto about the guide pin 73. On account thereof, a compression force is transmitted by way of the common articulation axle 71 to the movable lever 70, and from the latter on the first rotation axle 44 to the articulation element 43. In this manner, a torque which in the alignment of the articulation element 43 shown in FIG. 2 during the inwardly folded terminal position of the hinge part 20 acts in a counter-clockwise manner is transmitted to the articulation element 43. The torque thus counteracts a rotating motion of the articulation element 43 during outward folding of the hinge part 20. If and when the hinge part 20 is folded out counter to the action of the spring 76 to the extent that the first rotation axle 44 crosses the connection line between the first articulation 41.1 and the articulation axle 71, the compression force that is transmitted by the movable lever 70 causes a torque in the clockwise direction and thus in the direction of the rotating motion of the articulation element 43 that is caused by the outward folding of the hinge part 20. From this point in time on, the spring force that is transmitted supports the movement of the hinge part 20. By way of a corresponding layout of the spring 76 it is achieved that the hinge part 20, once partially opened, folds outward to the opened terminal position thereof in a self-acting manner. The movement herein is damped by the damper element 60 before the opened terminal position has been reached. Accordingly, the reversed motion sequence is performed during inward folding of the hinge part. Here too, the spring force initially counteracts inward folding of the hinge part 20, prior to said spring force acting in the movement direction of the hinge part 20 once the first rotation axle 44 has crossed the connection line between the first articulation 41.1 and the articulation axle 71. On account thereof, the last movement portion of the hinge part 20 during inward folding is performed in a self-acting manner.

The bias of the spring 76, and the torque that is generated by the spring 76, may be adapted by the tensioning element 84 of the spring tensioner 80 in such a manner that a self-acting movement of the hinge part in the case of cupboard doors or flaps of dissimilar weight that are guided by the hinge part 20 is enabled. To this end, the position of the slide 84.3 is displaced along the slider bar 83 with the aid of the knurled screw 84.1.

By mounting the damper element 60 by way of the counter bearing 61 thereof on the movable lever 70 it is achieved that the spacing between the counter bearing 61 and the first rotation axle 44 remains the same, independently of the position of the articulation element 43 and of the movable lever 70. The readjustment of the damper element 60, and thus the damping stroke thereof, is thus defined by the position at which the guide element 45 is held on the articulation element 43 and is rotated about the first rotation axle 44, and by the rotation angle between the articulation element 43 and the movable lever 70.

The damping stroke of the damper element during outward and inward folding of the hinge part 20 may be variably embodied by the position of the guide element 45 on the articulation element 43 and by the pivoting range of the guide element 45 about the first rotation axle 44. In this way, it is provided in the exemplary embodiment shown that during outward folding of the hinge part 20, from the first terminal position shown in FIG. 2 to the second terminal position shown in FIG. 6, up to reaching the maximum deflection of the damper element 60, initially a comparatively large angular range is passed by the guide element 45 by way of a correspondingly large readjustment of the damper element 60. Following the maximum deflection, a comparatively small angular range is passed by way of a correspondingly smaller readjustment of the damper element 60. The motion sequence is performed in the reversed order during inward folding of the hinge part 20. The damping stroke during outward folding of the hinge part 20 is thus chosen so as to be smaller than the damping stroke during inward folding of the hinge part 20.

By contrast, it is provided during the introduction of the spring force that the first rotation axle 44 as the coupling-in point for the spring force into the articulation element 43 during outward folding of the hinge part 20 crosses the connection line between the first articulation 41.1 and the articulation axle 71 already after a short rotating motion about the first articulation 41.1. The spring force counteracts the movement of the articulation element 43 and thus of the hinge part 20 only in a first small movement range, so as to subsequently act across a large movement range in the movement direction of the articulation element 43 and thus of the hinge part 20. Here too, the motion sequence is reversed during inward folding of the hinge part 20. Thus, the spring 76 acts across a large movement range of the hinge part 20 in the direction of an opening position of a cupboard door or a flap that is fastened to the hinge part 20, acting toward closing the cupboard door or the flap only in the direct proximity of the closing position.

By way of this asymmetrical effect of both the damping element 60 as well as of the spring 76 during outward and inward folding of the hinge part 20 it is achieved that opening a cupboard door or a flap, counter to the force of gravity acting thereon, with the support of the spring 76 is performed in a smooth-running manner or, in a last movement portion, in a self-acting manner. The movement herein is dampened just before the end of the opening procedure. By contrast, a significantly longer damping stroke is provided during closing of the cupboard door or of the flap, so as to avoid an impact of the cupboard door or the flap on a cupboard base unit. Herein, the cupboard door or the flap, respectively, in the last movement portion thereof is pulled in the closing position thereof in a self-acting manner.

The furniture hinge 10 may be adapted to cupboard doors and flaps of dissimilar weight by adjusting the spring bias.

FIG. 3 shows a fragment of the furniture hinge of FIG. 2, in the region of an articulation element 43, in the case of an inwardly folded hinge part 20. Herein, the housing lid 33 and the first articulation plate 43.1 of the articulation element 43 are illustrated so as to be semi-transparent, in order to allow a view onto the components lying there-behind.

The guide element 45 as the support bearing of the damper element 60 is mounted in the guide 46 on the articulation element 43. The guide 46 herein is embodied by elongate holes which are attached so as to be congruent, both in the first articulation plate 43.1 as well as in the second articulation plate 43.2 that is disposed in an obscured manner. The guide 46 thus enables a rotating motion as well as a linear readjustment of the guide element 45 that is mounted in the former. The elongate holes are aligned toward the first articulation 41.1, so as to be spaced apart from the first rotation axle 44. The adjustment element 50 is disposed between the guide 46 and the first articulation 41.1. As is also shown in the context of FIG. 4, the adjustment element 50 is rotatably mounted between the first and the second articulation plate 43.1, 43.2 of the articulation element 43. To this end, a tool engagement feature 51 is introduced in a corresponding through opening of the first articulation plate 43.1. As is shown in the context of FIG. 4, the adjustment element 50 is furthermore formed by an eccentric 52 having a first and a second eccentric disk 52.1, 52.2. Each eccentric disk 52.1, 52.2 on the circumference is assigned one latching curve 52.3, 52.4. The eccentric disks 52.1, 52.2 are spaced apart by an axle 53.

As can be seen from FIG. 3, the eccentric 52 may be rotated such that the former, by way of the external circumference and latching curves 52.3, 52.4 thereof covers part of the elongate holes of the guide 46. On account thereof, an adjustable variable end 46.1, having the eccentric 52 as a detent for the guide element 45, is achieved on that region of the guide 46 that faces the first articulation 41.1. Opposite thereto, a fixed end 46.2 delimits the guide 46.

When inwardly folding the hinge part 20 to the closed position illustrated, the guide element 45 by the damper element 60, counteracting the movement, is pushed against the variable end 46.1 of the guide. The detent for the guide element 45 may be displaced according to the latching curves 52.3, 52.4 by rotating the adjustment element 50. The position of the guide element 45 in the inwardly folded position of the hinge part 20 shown in the effective direction of the damper element 60 is thus defined by the adjustment element 50. The readjustment path of the damper element 60, and thus the damping stroke, during inward folding of the hinge part 20 may thus be adjusted by the adjustment element 50. Herein, a damping stroke that is adjustable at minimum results in the adjustment of the adjustment element 50 shown in FIG. 3, the latter allowing maximum linear movement of the guide element 45 in the guide 46. If and when the adjustment element 50 is rotated in such a manner that the latching curves 52.3, 52.4 protrude at maximum into the elongate holes of the guide 46, such that the guide element 45 is displaced in the direction of the fixed end 46.2 of the guide 46, a maximum damping stroke of the damper element during inward folding of the hinge part 20 is achieved. The damping stroke may be adjusted between the two extreme positions by way of respective intermediate positions of the adjustment element 50. It is achieved by the interaction of the latching curves 52.3, 52.4 and the guide element 45 that the adjustment element 50 can only be adjusted to defined latching positions. This enables a reproducible adjustment of the damping stroke as well as locking of the chosen adjustment.

In the inwardly folded terminal position of the hinge part 20, shown in FIG. 3, the tool engagement feature 51 of the adjustment element 50 is covered by the housing lid 33. During outward folding of the hinge part 20, the tool engagement feature 51 pivots into the region of the adjustment opening 35 of the housing lid 33. The adjustment of the damping stroke may then be performed with the cupboard door or the flap opened.

A piston rod 63, shown in FIG. 4, is routed through a cover 62 and is protected by the latter.

FIG. 4 shows the fragment of the furniture hinge 10 of FIG. 3, in a perspective illustration, in the case of a partially opened position of the hinge part 20. Herein, the first articulation plate 43.1 of the articulation element 43 is illustrated so as to be transparent.

The piston rod 63 of the damper element 60, the former being partially enveloped by the cover 62, at the end thereof has a guide-element receptacle 64 in which the guide element 45 that is embodied as a transverse pin is held. A setting element 65 in the form of an appendage is configured on the guide-element receptacle 64. The setting element 65, in the position of the hinge part illustrated, is aligned toward the axle 53 of the adjustment element 50 and bears on the latter.

By way of the setting element 65 the guide element 45 is displaced in relation to the fixed end 46.2 of the guide 46, independently of the adjustment of the adjustment element 50. During outward folding of the hinge part 20, from the closed terminal position thereof to the opened terminal position thereof, the guide element 45 is therefore positively moved from the variable end 46.1 of the guide 46 to the fixed end 46.2 of the latter, and held there. The position of the guide element 45 during opening of the hinge part 20 is fixedly defined on account thereof. The damping stroke of the damper element 60 during outward folding of the hinge part 20 is thus also fixedly defined, while the damping stroke during inward folding of the hinge part 20 may be adjusted by way of the adjustment element 50.

In the maximum adjustment of the adjustment element 50 illustrated, the guide element 45 is also held by the eccentric 52 on the side of the fixed end 46.2 of the guide 46. A maximum damping stroke is thus adjusted during inward folding of the hinge part 20 and thus during closing of a cupboard door or a flap that is fastened to the hinge part 20.

FIG. 5 shows the fragment of the furniture hinge 10 of FIG. 4, in a side view, in the case of a partially outward folded hinge part 20. The first articulation plate 43.1 is illustrated so as to be partially transparent.

In order for the intermediate position illustrated to be achieved, the guide 46, by way of the guide element 45, during the outward folding of the hinge part 20, commencing in the closing position shown in FIG. 3, has been pivoted in the clockwise direction about the first articulation 41.1. On account thereof, the setting element 65 has been aligned on the axle 53 of the adjustment element 50, and the guide element 45 has been pressed against the fixed end 46.2 of the guide 46. During the continuing movement in which the guide element 45 is pivoted about the first rotation axle 44 in the clockwise direction, the piston rod 63 of the damper element 60 is inserted into the damper element by the guide element 45, on account of which damping is effected. The damping stroke herein is fixedly defined by the fixed positioning of the guide element 45 on the fixed end 46.2 of the guide 46.

FIG. 6 shows the furniture hinge 10 of FIG. 2 in a second terminal position, in the case of an outwardly folded hinge part 20. The first articulation plate 43.1 is not shown.

The second articulation plate 43.2 of the articulation element 43 is pivoted about the first articulation 41.1 by outwardly folding the hinge part 20. By way of the movement of the articulation element 43 the first rotation axle 44 in relation to the position of the latter in FIG. 2 is alternated to the opposite side of the damper element 60, having thereby crossed the connection line between the guide element 45 and the counter bearing 61. On account thereof, the reversal of movement in the adjustment of the damper element 60 as has been described in the context of FIG. 2 is performed.

The setting element 65 is routed past the axle 53 of the adjustment element 50, but still bears thereon in such a manner that the guide element 45 is held on the fixed end 46.2 of the guide 45.

During outward folding of the hinge part 20 the articulation axis 71 as the connection point between the movable lever 70, the connection lever 72, and the base 82 of the spring tensioner 80, pivots about the rotary joint 81 shown in FIG. 2. The rotation in the present illustration is performed in the clockwise direction. During the folding motion thus generated between the base 82 and the connection lever 72, the spring 76 is relaxed and the released energy by way of the movable lever 70 is transmitted to the multiple-axle articulation connection 40 and thus to the pivot arm 20.

The movable lever 70 and the connection lever 72 are disposed and shaped in such a manner that both the former during the movement thereof between the two terminal positions do not cross the positions of the fastening receptacles 32.1, 32.2, 32.3, independently of the adjustment of the spring tensioner 80 or of the adjustment element 50. Fastening elements may thus be routed through the fastening receptacles 32.1, 32.2, 32.3 without blocking the movement of the hinge part 20.

Figure 7:
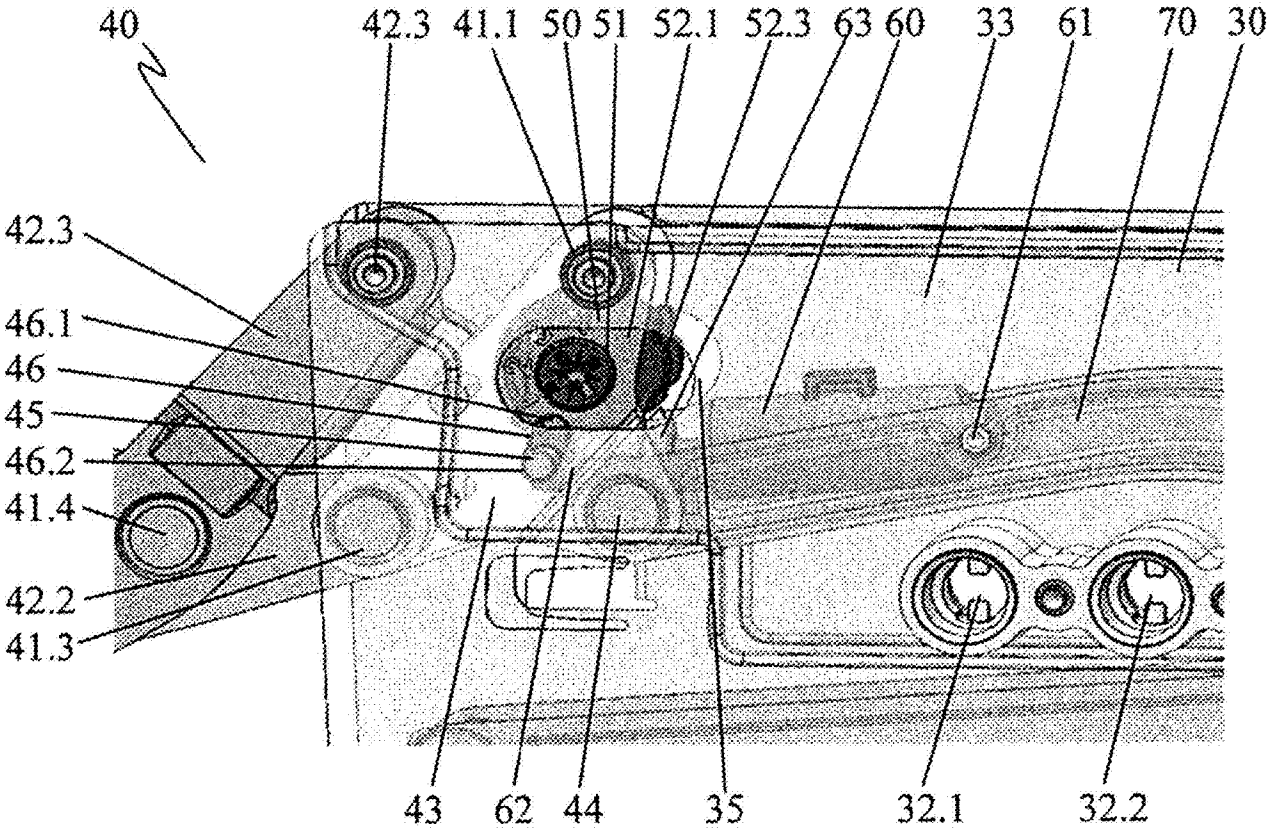
FIG. 7 shows a fragment of the furniture hinge of FIG. 6, in the region of the articulation element.

FIG. 7 shows a fragment of the furniture hinge 10 according to FIG. 6, in the region of the articulation element 43. The first articulation plate 43.1 of the articulation element 43, and the housing lid 33 are illustrated so as to be semi-transparent.

The position of the articulation element 63 in the case of a hinge part 20 that is outwardly pivoted to the second terminal position thereof is shown. In this position, the tool engagement feature 51 of the adjustment element 50 is positioned so as to be opposite the adjustment opening 35 in the housing lid 33, the former thus being accessible from the outside.

The guide element 45 is held at the fixed end 46.2 of the guide 46, on account of which the deflection of the damper element 60 is established in this position of the articulation element 63 and thus of the hinge part 20.

As has been explained above, the spring 76 during the opening procedure or during the closing procedure, respectively, is further extended or relaxed. This is caused by mutually pivoting the two levers (spring tensioner 80 and connection lever 72). The two spring bearings 84.4 and 75 are simultaneously repositioned. While the spring bearing 84.4 pivots about the rotary joint 81, the spring bearing 74 is offset in a linear manner by means of the linear guide 34. Offsetting herein is performed in the depth direction of the furniture hinge 10. Herein, controlling the repositioning motion of the spring bearing 74 is controlled such that the latter in the closing positing according to FIG. 2 is displaced in the direction toward the spring bearing 84.4. A reduction of the spring tension is therefore achieved by the displacement. By contrast, the spring bearing 74 and 84.4 in the opening position as shown in FIG. 6 are displaced in the opposite direction. Additional spring tensioning is thus achieved on top of the tensioning of the spring 76 that is caused as a result of a displacement of the spring bearing 74 in the opposite direction in the linear guide 34. A homogenization of the spring force may be achieved by way of controlling the two spring bearings 84.4 and 74 in such a manner that as uniform a manual force as possible is required in order for the flap to be moved from the closing to the opening position and vice-versa, respectively. The displacement of the spring bearing 74 is performed by means of the movable lever 70. The latter therefore assumes the functionality of an actuator.

The invention claimed is:

1. A furniture hinge (10) having a fastening portion (30), and a hinge part (20) that is pivotably connected to the fastening portion (30) by way of a multiple-axle articulation connection (40), wherein a spring (76) indirectly or directly biases the hinge part (20) in relation to the fastening portion (30) in a readjustment path of the hinge part (20) from an opening to a closing position and/or from the closing to the opening position of the hinge part (20), wherein the spring (76) is tensioned or tensionable between a first spring bearing and a second spring bearing (74, 84.4), the first spring bearing (74) in connection with the hinge part (20) and the second spring bearing (84.4) in connection with the fastening portion (30), wherein the spring (76) during movement of the hinge part (20) from the opening to the closing position and/or during movement of the hinge part (20) from the closing to the opening position, is readjusted at the two spring bearings (74, 84.4) wherein at least one of the two spring bearings (74. 81,4) is readjustable in a linear manner by a linear guide (34), or is pivotably readjustable about an axle, or is readjustable on an arcuate guiding path by means of a guide.

2. The furniture hinge as claimed in claim 1, further including two levers (72, 80), wherein the two spring bearings (74, 84.4) of the spring (76) are respectively connected to the two levers (72, 80).

3. The furniture hinge as claimed in claim 2, two levers (72, 80) interconnected by way of an articulation, while forming a common articulation axle (71).

4. The furniture hinge as claimed in claim 3 wherein the two levers (72, 80) are mutually pivotable.

5. The furniture hinge as claimed in claim 3, wherein the articulation connection (40) is indirectly or directly coupled to both spring bearings (74, 84.4) by means of a setting unit, and wherein the spring bearings (74, 84.4) are readjusted by means of the setting unit.

6. The furniture hinge as claimed in claim 5, wherein the setting unit acts directly on the articulation point between the two levers (72, 80), to which the spring bearings (74, 84.4) are coupled.

7. The furniture hinge as claimed in claim 6, wherein the setting unit is configured as a movable lever (70) which by way of an articulation that forms a first rotation axle (44) is indirectly or directly coupled to the articulation connection (40).

8. The furniture hinge as claimed in claim 5, wherein the setting unit is a movable lever (70).

9. The furniture hinge as claimed in claim 1 wherein one spring bearing (84.4) is connected to a spring tensioner (80) by means of which the spacing between the spring bearings (74, 84.4) is adjustable, and/or by means of which the torque that is introduced into the articulation connection (40) by the spring (76) is variable.

10. The furniture hinge as claimed in claim 1, wherein the opening motion of the hinge part (20) and/or the closing motion of the hinge part (20) is dampable at least in regions by means of a damper element (60) between the articulation connection (40) and the spring (76).

11. The furniture hinge as claimed in claim 10, wherein the damper element (60) is configured as a linear fluid-type damper.

12. The furniture hinge as claimed in claim 10, wherein the damper element (60) is effective in the functional region between the articulation connection (40) and the spring (76).

13. An item of furniture having a furniture base unit and a flap or a door that is articulated thereon by means of a furniture hinge (10) according to claim 1, wherein the manual force required during the opening and/or closing motion remains almost constant, preferably remains constant at a deviation of +/−30%.

* * * * *